United States Patent [19]

Verduin et al.

[11] 4,256,009

[45] Mar. 17, 1981

[54] DISCO LAMP CONTROLLER FOR COIN-OPERATED PHONOGRAPH

[75] Inventors: Lee C. Verduin, Grand Rapids; Paul E. Kitchka, Sparta, both of Mich.

[73] Assignee: Rowe International, Inc., Whippany, N.J.

[21] Appl. No.: 958,154

[22] Filed: Nov. 6, 1978

[51] Int. Cl.[3] ..... A63J 17/00

[52] U.S. Cl. ..... 84/464 R; 340/366 B; 362/811

[58] Field of Search ..... 84/464; 307/240, 271, 307/116; 340/371, 366 B; 46/227, 229; 328/196; 272/10; 274/1 B, 1 K; 360/79; 362/87, 811

[56] References Cited

U.S. PATENT DOCUMENTS 3,798,638 3/1974 Goldschmied ..... 84/464

OTHER PUBLICATIONS

Disco Lights, Elektor, vol. 1, No. 6, pp. 924–926, Sep. 1975.

*Primary Examiner*—L. T. Hix
*Assistant Examiner*—Stafford D. Schreyer
*Attorney, Agent, or Firm*—Shenier & O'Connor

[57] ABSTRACT

A disco lamp controller for a coin-operated phonograph in which a signal derived from the audio amplifier signal of the phonograph is applied to the trigger input of an astable multivibrator the output of which is applied to a register the outputs of which cause lamps sequentially to light in time to the beat of the music being played. In the absence of the audio signal the lamps light at a constant frequency.

7 Claims, 1 Drawing Figure

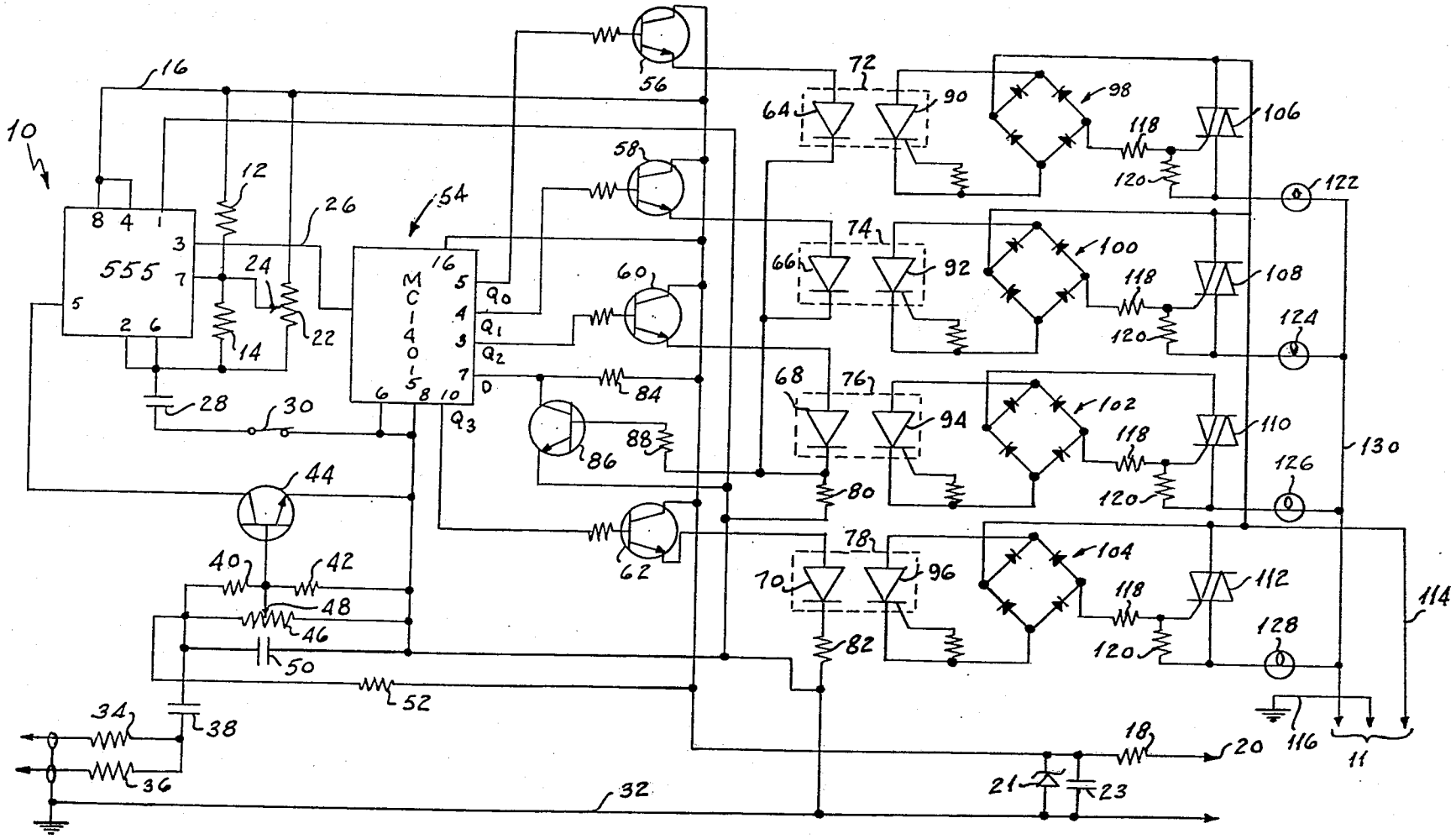
555
MC 4015
Q0
Q1
Q2
Q3
D

DISCO LAMP CONTROLLER FOR COIN-OPERATED PHONOGRAPH

BACKGROUND OF THE INVENTION

This invention relates to coin-operated phonograph and, more particularly, to a disco lamp controller for a coin-operated phonograph.

Owing largely to the cost of providing "live" music for dancing in nightclubs, and the like, so-called "discotheques" have become increasingly popular as establishments for dancing. In such establishments as is implied by the English translation of the name, music is provided from recordings. Moreover, in such establishments the use of light has become increasingly associated with the music in order to heighten the attractiveness of the establishment and the excitement associated with the music.

There are also known in the prior art coin-operated phonographs which are installed in restaurants, taverns, and the like, for the entertainment of customers. Many of these coin-operated phonographs are provided with decorative lighting, which is intended to draw the attention of potential customers to the phonograph. It is, of course, desirable from the operator's standpoint that the use of the coin-operated phonograph be frequent. Two factors are of prime importance in contributing to increased use of the phonograph. First, anything which draws the customer's attention to the phonograph contributes to increased use. Secondly, anything which increases the customer's enjoyment of the music as it is played contributes to increasing the number of plays.

We have invented a disco lamp controller for a coin-operated phonograph which attracts the attention of potential customers to the phonograph. Our disco lamp system adds to the excitement of listeners hearing the music. It is relatively simple in construction and inexpensive to manufacture for the results achieved thereby.

SUMMARY OF THE INVENTION

One object of our invention is to provide a disco lamp controller for a coin-operated phonograph which contributes to increased use of the phonograph.

Another object of our invention is to provide a disco lamp controller for a phonograph which attracts the attention of potential customers to the phonograph.

A further object of our invention is to provide a disco lamp controller for a coin-operated phonograph which adds to the excitement of those listening to music being played by the phonograph.

Yet another object of our invention is to provide a disco lamp controller for a coin-operated phonograph which provides a light display which is synchronized with the rhythm of the music being played by the phonograph.

Other and further objects of our invention will appear from the following description.

In general our invention contemplates the provision of a disco lamp controller for a coin-operated phonograph in which a pulse generating circuit sequentially illuminates a plurality of lamps mounted on or adjacent to the phonograph at a constant frequency when no music is being played. When music is being played by the phonograph the amplifier audio signal of the phonograph is employed to control the pulse generator so as to put out pulses with such a timing as to illuminate the lamps in time with the music being played. We provide our system with means for regulating the pulse generator in such a way that all of the lamps are illuminated continually while the phonograph is on in the event that the operator wishes to dispense with the sequential illumination.

In the accompanying drawing to which reference is made in the instant specification, the FIGURE is a schematic view of one form of circuit which may be used in our disco lamp controller for a coin-operated phonograph.

DESCRIPTION OF THE PREFERRED EMBODIMENT

Referring now to the drawing, one form of circuit which may be employed to control the operation of our disco lamp controller for a coin-operated phonograph, or the like, includes a 555 circuit indicated generally by the reference character 10, connected to operate as an astable multivibrator. Such a circuit is shown and described in greater detail on pages 171 to 175 of "TTL Cookbook" by Don Lancaster, published by Howard W. Sands & Co., Inc., 4300 West 62nd Street, Indianapolis, Ind. 46268. We connect a pair of resistors 12 and 14 forming a voltage divider between a line 16 connected by a resistor 18 to a terminal 20 at a potential of about 30 volts and one terminal of a capacitor 28 connected by a switch 30 to a ground line 32. A Zener diode 21 shunted by a capacitor 23 regulates the 30 volts at terminal 20 down to about 13 volts on line 16. A resistor 22 connected across resistors 12 and 14 is provided with a movable brush 24, which is connected to the common terminal of resistors 12 and 14, which leads to the discharge pin 7 of the 555 circuit. As will readily be apparent to those skilled in the art, so long as no trigger input is applied to the pin 5 of the 555 circuit, it will produce output pulses at a constant frequency on a line 26 leading from pin 3. The frequency at which the circuit operates in this state can be changed by adjusting the position of brush 24 along resistor 22.

We connect the right and left amplifier channels of the phonograph amplifier (not shown) with which our system is used to respective summing resistors 34 and 36 having a common terminal connected to a coupling capacitor 38. Respective voltage dividing resistors 40 and 42 connected between capacitor 38 and ground line 32 have a common terminal which is connected to the base of a transistor 44, the emitter of which is connected to ground line 32 and the collector of which is connected to the trigger input pin 5 of the 555 circuit 10. A resistor 46 connected across resistors 40 and 42 has a brush 48 connected to the common terminal of resistors 40 and 42 to vary the effect of the audio signal input in a manner to be described. We connect a capacitor 50 across resistor 46 and connect a resistor 52 between the common terminal of capacitor 50 and resistor 40 and the line 16. The audio signal from the phonograph with which our controller is used has a maximum value of about 0.86 volts. The particular transistor 44 which we employ requires a base potential of somewhat more than 0.7 volts before it conducts. In order to ensure that the 0.86 volts will be effective we select the value of resistor 52 to provide a pre-bias for transistor 44 of approximately 0.7 volts.

Our circuit includes a shift register indicated generally by the reference character 54, the pins 6 and 8 of which are connected to ground line 32, while pin 16 is connected to input potential line 16. The respective pins 5, 4, 3, and 10 provide the outputs $Q_0$ through $Q_3$ of the counter, while pin 7 is adapted to receive the data input. Shift register 54 may be of any suitable type known to the art. In the particular circuit illustrated in the drawing we have shown a Motorola MC14015 dual 4-bit register of which we employ only half. We apply the respective outputs $Q_0$ to $Q_3$ of the register 54 to the bases of respective transistors 56, 58, 60, and 62. We connect each of the collectors of transistors 56, 58, 60, and 62 to input potential line 16, while the respective emitters of the transistors are connected to light emitting diodes 64, 66, 68, and 70 of respective optical couplers 72, 74, 76, and 78. It will readily be appreciated that where any output of $Q_0$ through $Q_3$ exists, its corresponding transistor 56 conducts to energize the associated light emitting diode.

A common resistor 80 connects diodes 64, 66, and 68 to line 32, while a resistor 82 connects diode 70 to line 32. A collector resistor 84 connects transistor 86 to line 16. The emitter of transistor 86 is connected to the ground line 32. A resistor 88 connects the common terminals of diodes 64, 66, and 68 to the base of transistor 86. Owing to the arrangement just described, if any of the first three diodes 64, 66, and 68 conducts transistor 86 is rendered conductive with the result that the data input terminal of register 54 is low. However, when none of the first three outputs $Q_0$ to $Q_2$ of counter 54 is high, transistor 86 is non-conductive, so that the data input terminal of register 54 is high. In response to each of the clock pulses applied to the pin 9 register 54, the state of the data input from transistor 86 is transferred to $Q_0$; the state of $Q_0$ is transferred to $Q_1$; the state of $Q_1$ is transferred to $Q_2$; and the state of $Q_2$ is transferred to $Q_3$. It will thus be seen that under the normal conditions of operation, one and only one of the LEDs 64, 66, 68, and 70 is on.

Couplers 72, 74, 76, and 78 include respective light responsive devices 90, 92, 94, and 96, which are rendered conductive in response to light impinging thereon from the associated LED 64, 66, 68, or 70. The light responsive devices 90, 92, 94, and 96 may be either photo transistors or light responsive silicon controlled rectifiers, which we have indicated in the circuit illustrated in the FIGURE. We connect respective full wave rectifier circuits 98, 100, 102, and 104 to one input line 114 of a suitable source of alternating current, including a third wire ground conductor 116. We connect respective pairs of voltage dividing resistors 118 and 120 and lamps 122, 124, 126, and 128 in series between the other output terminals of the full wave rectifiers and the other input line 130 of the alternating current source. First main terminals of the respective triacs 106, 108, 110, and 112 are connected to the line 114 to which first-named full wave rectifier output terminals are connected. The other main terminals of triacs 106, 108, 110, and 112 are connected to the common terminal of the associated resistor 120 and one of the lamps 122, 124, 126, and 128. The common terminal of the voltage dividing resistors 118 and 120 associated with each of the triacs provides the appropriate bias for the gate of the triac.

In operation of our circuit, with no audio input signals applied to the resistors 34 and 36, the circuit 555 will oscillate at a predetermined rate determined by the setting of brush 24. In response to the output on line 26, after the first three input pulses occurring following the application of power to the circuit, outputs $Q_0$ through $Q_3$ will sequentially be high. As a result of this condition, the lamps 122, 124, 126, and 128 will flash in sequence.

When music is being played so that the audio signals are applied to the two resistors 34 and 36, the outputs will be added to cause transistor 44 to conduct in such a manner as to trigger the circuit 555, such that the output on line 26 rather than being regular corresponds to the beat of the music. In response to this input, the register 54 shifts from one output to the next in time with the music, so that the lamps 122, 124, 126, and 128 are illuminated in time with the beat of the music. For example, if a samba were being played the lamps 122, 124, 126, and 128 would flash sequentially at timed intervals corresponding to a samba rhythm.

Under certain circumstances the person in charge of the establishment in which the phonograph is located may wish to dispense with the flashing of the lamps 122, 124, 126, and 128 and yet desire to have all lamps lit. In such a circumstance he opens switch 30 so that only distributed capacitance is between terminals 2 and 6 of circuit 54 and ground. Under this condition the output frequency of circuit 10 will be so high that all lamps will be constantly illuminated.

As has been pointed out hereinabove, moving brush 24 will change the output frequency of circuit 10 in the absence of an audio signal. Adjustment of brush 38 changes the proportion of the audio signal applied to transistor 44 to change the level at which circuit 10 is triggered. It thus provides a sensitivity control.

It will be seen that we have accomplished the objects of our invention. We have provided a disco lamp controller for increasing the play of a coin-operated phonograph. Our controller draws attention to the phonograph. It increases the enjoyment of listeners during the course of play. It is simple in construction and operation for the result achieved. It is readily adaptable to existing machines.

It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. In a phonograph having means for producing an audio signal representing music having a rhythm, a pulse generator having a trigger input terminal, said pulse generator normally producing output pulses at a constant rate in the absence of a signal input at said trigger input terminal, the output pulse rate of said generator varying in response to a varying input signal at said trigger terminal, means responsive to said audio signal for applying to said trigger terminal an input signal incorporating the rhythm of said audio signal, a plurality of devices adapted to be energized to produce light, a source of alternating current power, and means including respective optical couplers responsive to pulses put out by said generator sequentially to illuminate said devices at a constant rate in the absence of an input at said trigger terminal and sequentially to illuminate said devices in accordance with the rhythm of an input signal applied to said terminal by said means responsive to said audio signal.

2. In a phonograph having means for producing an audio signal representing music having a rhythm, a pulse generator having a trigger input terminal, a direct current control voltage for said pulse generator, said pulse generator normally producing output pulses at a constant rate in the absence of a signal input at said trigger input terminal, the output pulse rate of said generator varying in response to a varying input signal at said trigger terminal, means responsive to said audio signal for applying to said trigger terminal an input signal incorporating the rhythm of said audio signal, a plurality of devices adapted to be energized to produce light, a source of alternating current power, and means including respective optical couplers responsive to pulses put out by said generator sequentially to illuminate said devices at a constant rate in the absence of an input at said trigger terminal and sequentially to illuminate said devices in accordance with the rhythm of an input signal applied to said terminal by said means responsive to said audio signal.

3. In a phonograph having means for producing an audio signal representing music having a rhythm, a pulse generator having a trigger input terminal, said pulse generator normally producing output pulses at a constant rate in the absence of a signal input at said trigger input terminal, the output pulse rate of said generator varying in response to a varying input signal at said trigger terminal, means responsive to said audio signal for applying to said trigger terminal an input signal incorporating the rhythm of said audio signal, a plurality of devices adapted to be energized to produce light, a shift register having a number of output terminals corresponding to the number of said devices, means for applying the output pulses of said generator to said shift register sequentially to produce outputs at the register output terminals and means responsive respectively to said register outputs for sequentially illuminating said devices at a constant rate in the absence of an input at said trigger terminal and sequentially illuminating said devices in accordance with the rhythm of an input signal applied to said terminal by said means responsive to said audio signal.

4. In a phonograph having means for producing an audio signal representing music having a rhythm, a pulse generator having a trigger input terminal, said pulse generator normally producing output pulses at a constant rate in the absence of a signal input at said trigger input terminal, the output pulse rate of said generator varying in response to a varying input signal at said trigger terminal, means responsive to said audio signal for applying to said trigger terminal an input signal incorporating the rhythm of said audio signal, a plurality of devices adapted to be energized to produce light, and means responsive to pulses put out by said generator sequentially to illuminate said devices at a constant rate in the absence of an input at said trigger terminal and sequentially to illuminate said devices in accordance with the rhythm of an input signal applied to said terminal by said means responsive to said audio signal.

5. In a phonograph having means for producing an audio signal incorporating a musical rhythm, apparatus including a plurality of devices activatable to produce light, means normally operative to activate said devices in sequence at a constant frequency, and means responsive to said audio signal for modifying the operation of said device activating means to activate said devices in sequence in accordance with said musical rhythm, and second means for modifying the operation of said device activating means for activating all of said devices at the same time.

6. In a phonograph having means for producing an audio signal incorporating a musical rhythm, apparatus including a plurality of devices activatable to produce light, means normally operative to activate said devices in sequence at a constant frequency, and means responsive to said audio signal for modifying the operation of said device activating means to activate said devices in sequence in accordance with said musical rhythm.

7. In a phonograph having means for producing an audio signal incorporating a musical rhythm, apparatus including a plurality of devices activatable to produce light, and means responsive to said audio signal for activating said devices in sequence in accordance with said musical rhythm.

* * * * *

UNITED STATES PATENT AND TRADEMARK OFFICE

CERTIFICATE OF CORRECTION

PATENT NO. : 4,256,009

DATED : March 17, 1981

INVENTOR(S) : Lee C. Verduin and Paul E. Kitchka

It is certified that error appears in the above-identified patent and that said Letters Patent are hereby corrected as shown below:

Column 6, line 23, "and" should read -- first --.

Signed and Sealed this

*Second* Day of *June 1981*

[SEAL]

*Attest:*

RENE D. TEGTMEYER

*Attesting Officer*

*Acting Commissioner of Patents and Trademarks*